US009997034B2

(12) United States Patent
Yang et al.

(10) Patent No.: US 9,997,034 B2
(45) Date of Patent: Jun. 12, 2018

(54) FIRE SCENE EVACUATION GUIDING DEVICE

(71) Applicant: NEXCOM International Co., Ltd., New Taipei (TW)

(72) Inventors: Chung-Shu Yang, New Taipei (TW); Alexander I-Chi Lai, New Taipei (TW)

(73) Assignee: NEXCOM INTERNATIONAL CO., LTD., New Taipei (TW)

( * ) Notice: Subject to any disclaimer, the term of this patent is extended or adjusted under 35 U.S.C. 154(b) by 0 days. days.

(21) Appl. No.: 15/453,435

(22) Filed: Mar. 8, 2017

(65) Prior Publication Data

US 2018/0137721 A1 May 17, 2018

(30) Foreign Application Priority Data

Nov. 15, 2016 (TW) ..... 105137292 A

(51) Int. Cl.
*G08B 7/06* (2006.01)
*G08B 17/06* (2006.01)

(52) U.S. Cl.
CPC ..... *G08B 7/066* (2013.01); *G08B 17/06* (2013.01)

(58) Field of Classification Search
CPC ..... G08B 7/066; G08B 17/06
See application file for complete search history.

(56) References Cited

U.S. PATENT DOCUMENTS

| | | | | |
|---|---|---|---|---|
| 3,559,194 | A * | 1/1971 | Bisberg | G08B 17/12 340/333 |
| 4,357,602 | A * | 11/1982 | Lemelson | G08B 25/10 340/524 |
| 4,540,980 | A | 9/1985 | Porco | |
| 8,736,444 | B2 | 5/2014 | Farley et al. | |
| 2003/0076867 | A1 | 4/2003 | Mundt | |
| 2013/0298956 | A1* | 11/2013 | Hiller | B64D 41/00 136/212 |

FOREIGN PATENT DOCUMENTS

| | | |
|---|---|---|
| TW | M495152 | 12/2015 |
| TW | M514285 | 12/2015 |
| WO | 2015111459 A1 | 7/2015 |

OTHER PUBLICATIONS

Simon Lineykin; Shmuel Ben-Yaakov; "Modeling and Analysis of Thermoelectric Modules," IEEE Transactions on Industry Applications, vol. 43, No. 2, Mar./Apr. 2007, pp. 505-512.*

(Continued)

*Primary Examiner* — Nader Bolourchi
(74) *Attorney, Agent, or Firm* — Chun-Ming Shih; HDLS IPR Services

(57) ABSTRACT

A fire scene evacuation guiding device includes an indicator (100) and a thermoelectric converter (200). The thermoelectric converter (200) is electrically connected with the indicator (100), the thermoelectric converter (200) includes a first detecting end (210) and a second detecting end (220), and the first detecting end (210) and the second detecting end (220) are arranged away from each other. The thermoelectric converter (200) can provide evacuation instructions according to a real time situation at a fire scene.

10 Claims, 5 Drawing Sheets

(56) References Cited

OTHER PUBLICATIONS

S. Dalola; V. Ferrari; M. Guizzetti; D. Marioli; E. Sardini; M. Serpelloni; "Autonomous Sensor System with RF Link and Thermoelectric Generator for Power Harvesting," 2008 IEEE Instrumentation and Measurement Technology Conference, Victoria, Vancouver Island, Canada, May 12-15, 2008, pp. 1376-1380.*
"Thermoelectric Module (TEM) Peltier Element Mounting Procedure," Tetechnology, Inc., Feb. 26, 2007, online: http://www.everredtronics.com/files/tem_thermoelectric_module)_mounting_procedure.pdf.*
Takenobu Kajikawa; "Overview of Thermoelectric Power Generation Technologies in Japan," Shonan Institute of Technology, Japan, Jan. 4, 2011, online: http://www.everredtronics.com/files/TE_power.generation.in.Japan.pdf.*
Search Report dated Sep. 22, 2017 of the corresponding European patent application No. 17157327.2.
Office Action dated Jul. 4, 2017 of the corresponding Taiwan patent application No. 105137292.

* cited by examiner

FIRE SCENE EVACUATION GUIDING DEVICE

TECHNICAL FIELD

The present invention relates to a fire scene evacuation guiding device and, in particular, to a thermoelectrically-operated fire scene evacuation guiding device.

BACKGROUND

In most buildings, the fire scene evacuation guiding devices are typically indication lamps installed on escape doors or are lamps at hallways indicating the directions of the escape doors. However, such fire scene evacuation guiding devices can only indicate predetermined escape directions and the positions of existing escape facilities, and cannot provide evacuation instructions according to a real time situation at a fire scene. If a person escapes toward a wrong direction and then returns, precious escape time is thus wasted.

Accordingly, the target of the inventor is to solve the above-mentioned problems, on the basis of which the present invention is accomplished.

SUMMARY

The present invention provides a thermoelectrically-operated fire scene evacuation guiding device.

The present invention provides a fire scene evacuation guiding device, comprising an indicator 100 and a thermoelectric converter. The thermoelectric converter is electrically connected to the indicator. The thermoelectric converter includes a first detecting end and a second detecting end, and the first detecting end and the second detecting end are arranged away from each other.

In the fire scene evacuation guiding device of the present invention, each of the first detecting end and the second detecting end is thermally coupled to a heat conductive pipe. A heat conductive insulating structure is connected between each of the heat conductive pipes and each of the first detecting end and the second detecting end thermally coupled to the respective heat conductive pipes. The heat conductive insulating structure consists of a ceramic material.

The fire scene evacuation guiding device further includes a control module; the control module is electrically connected to the indicator and the thermoelectric converter. The fire scene evacuation guiding device further includes another indicator electrically connected to the control module.

The present invention further provides a fire scene evacuation guiding device which includes a door panel, an indicator and a thermoelectric converter. The indicator is disposed on one side of the door panel. The thermoelectric converter is electrically connected to the indicator, the thermoelectric converter includes a first detecting end and a second detecting end, and the first detecting end and the second detecting end are respectively disposed on two sides of the door panel.

The fire scene evacuation guiding device further includes a control module, and the control module is electrically connected to the indicator and the thermoelectric converter. The fire scene evacuation guiding device further includes another indicator electrically connected to the control module and disposed on the other side of the door panel.

In the fire scene evacuation guiding device of the present invention, each of the first detecting end and the second detecting end is thermally connected to a heat conductive pipe. A heat conductive insulating structure is connected between each of the heat conductive pipes and each of the first detecting end and the second detecting end thermally coupled to the respective heat conductive pipes.

The fire scene evacuation guiding device is activated by the thermoelectric converter, so evacuation instructions can be given according to a real time situation at a fire scene. Furthermore, the thermoelectric converter can generate electric power from the heat at the fire scene, so extra power is not required.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
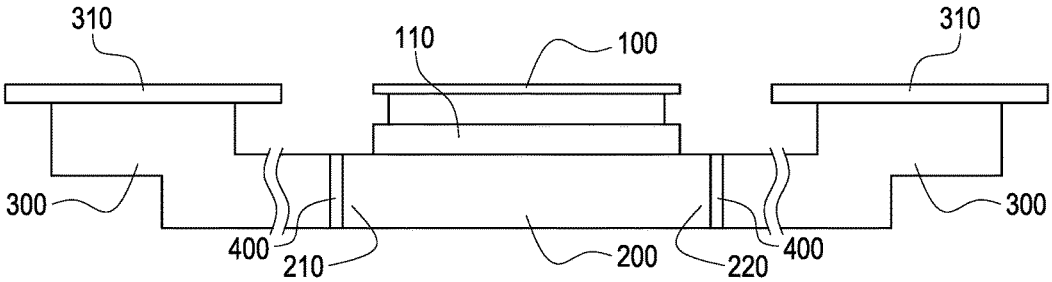
FIG. 1 is a schematic view showing a fire scene evacuation guiding device according to the first embodiment of the present invention.
Figure 3:
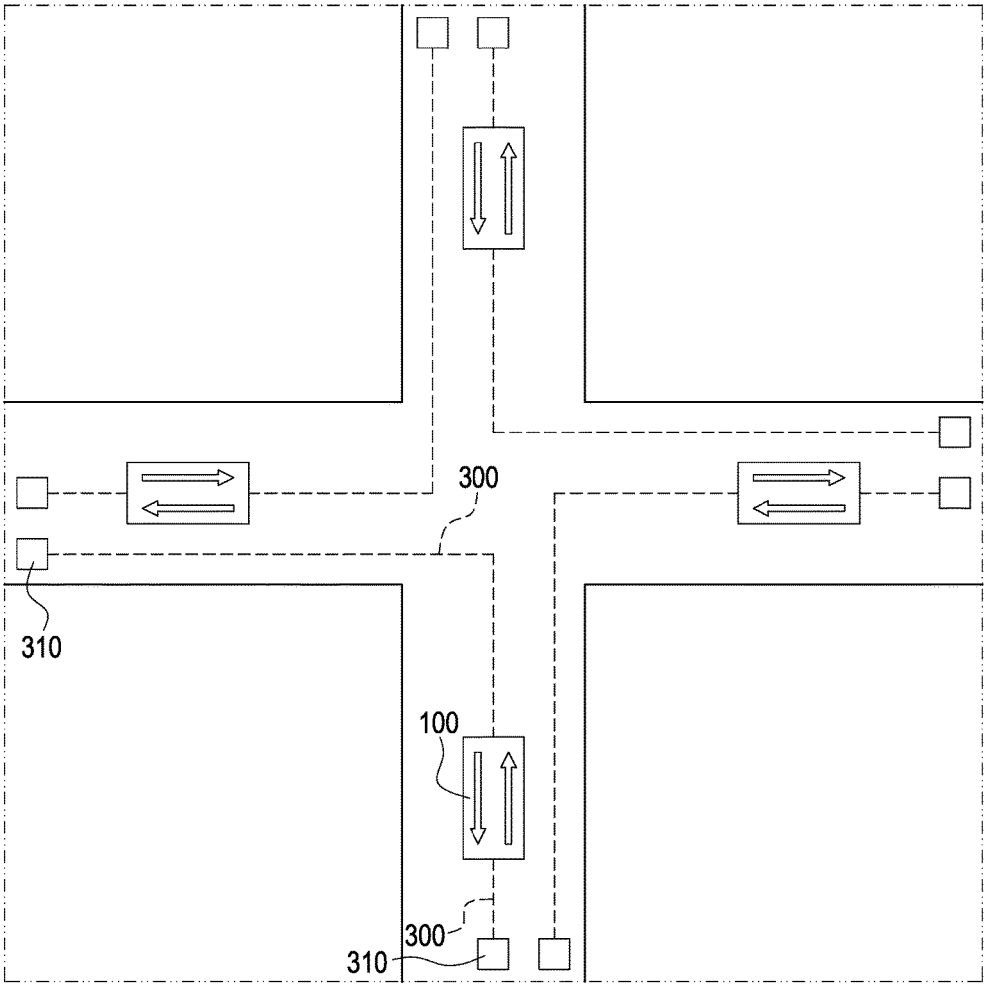

Please refer to FIGS. 1 and 3, showing a fire scene evacuation guiding device according to the first embodiment of the present invention. The fire scene evacuation guiding device includes an indicator 100, a thermoelectric converter 200 disposed corresponding to the indicator 100, and a control module 110 disposed corresponding to the indicator 100.

The indicator 100 is an electrically activated indicating device for indicating an evacuation direction. The present invention is not limited to any specific type of the indicator 100. The indicator 100 can be, for example, a light emitting element, a light emitting lamp capable of showing an indication arrow, or a liquid crystal display panel. In the present embodiment, the fire scene evacuation guiding device preferably includes an indicator 100, and the indicator 100 can selectively indicate different directions.

In the present embodiment, the fire scene evacuation guiding device preferably includes a thermoelectric converter 200 disposed corresponding to the indicator 100. In the present embodiment, the thermoelectric converter 200 is preferably a thermoelectric pile. The thermoelectric converter 200 includes a first detecting end 210 and a second detecting end 220, and the first detecting end 210 and the second detecting end 220 are arranged away from each other.

In the fire scene evacuation guiding device of the present embodiment, each of the first detecting end 210 and the second detecting end 220 is thermally coupled to a heat conductive pipe 300 to thereby extend a detection range and bypass visual obstructions (e.g. a hallway corner or a door). The heat conductive pipe 300 is preferably thermally coupled to the ground, a wall, or a detection point 310 on a roof. The detection point 310 is not limited to any specific location. Preferably, a heat conductive insulating structure 400 is connected between each of the heat conductive pipes 300 and each of the first detecting end 210 and the second detecting end 220 thermally coupled to the respective heat conductive pipes 300. The heat conductive insulating structure 400 consists of a ceramic material.

In the present embodiment, the control module 110 is disposed between the indicator 100 and the thermoelectric converter 200, and the control module 110 is electrically connected to the indicator 100 and the thermoelectric converter 200, so that the thermoelectric converter 200 is electrically connected to the indicator 100. The thermoelectric converter 200 generates a voltage from a temperature difference between the first detecting end 210 and the second detecting end 220. The control module 110 can activate the indicator 100 by a value of the voltage generated by the thermoelectric converter 200, and an evacuation direction at a fire scene can be indicated according to a direction of the voltage generated by the thermoelectric converter 200.

Figure 2:
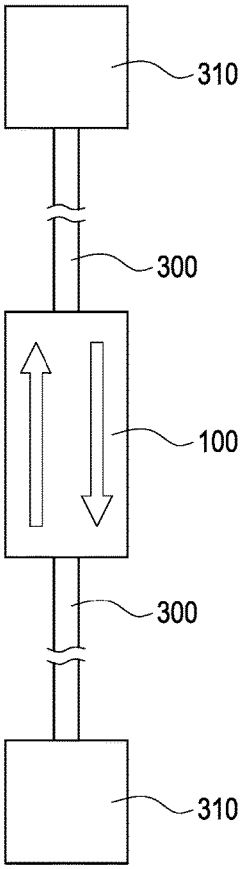
FIGS. 2 and 3 are disposition views showing the fire scene evacuation guiding device according to the first embodiment of the present invention.
Figure 4:
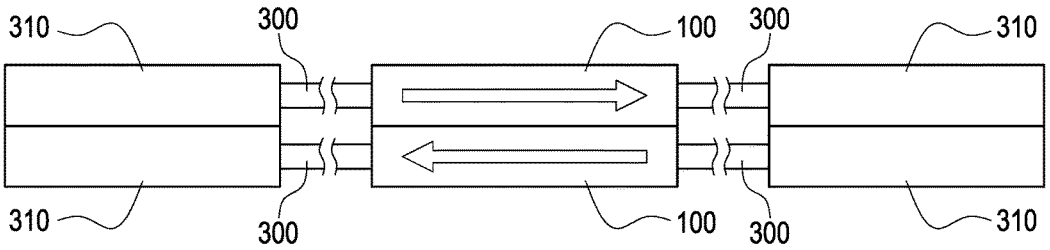
FIG. 4 is a schematic view illustrating the fire scene evacuation guiding device according to the second embodiment of the present invention.

Referring to FIGS. 2 and 4, the second embodiment of the present invention provides a fire scene evacuation guiding device. The fire scene evacuation guiding device includes the indicator 100, the thermoelectric converter 200 and the control module 110 of the first embodiment. In the present embodiment, two sets of the same components are disposed; however, the present invention is not limited to any specific numbers of the components. The present embodiment is different from the first embodiment in that, each indicator 100 can emit light to show a predetermined indication arrow, and the pair of the indicators 100 is arranged reversely to each other, so as to indicate two opposite directions.

The thermoelectric converter 200 generates a voltage from a temperature difference between the first detecting end 210 and the second detecting end 220. The control module 110 can control the indicator 100 to be activated or not according to a value and a direction of the voltage generated by the thermoelectric converter 200, and the control module 110 can control turning on the light of the indicator 100 indicating an evacuation direction at the fire scene.

Figure 5:
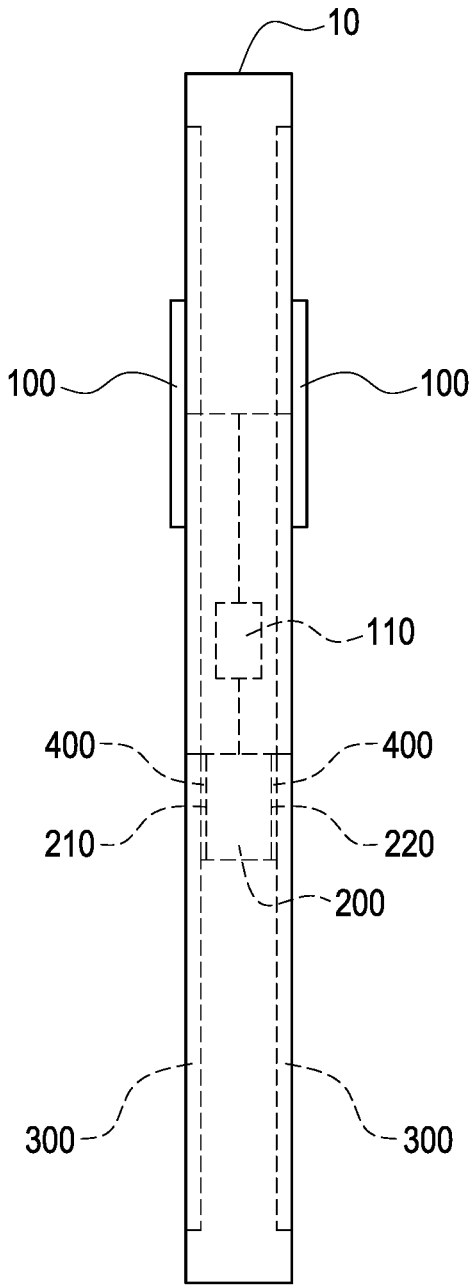
FIGS. 5 and 6 are schematic views illustrating the fire scene evacuation guiding device according to the third embodiment of the present invention.
Figure 6:
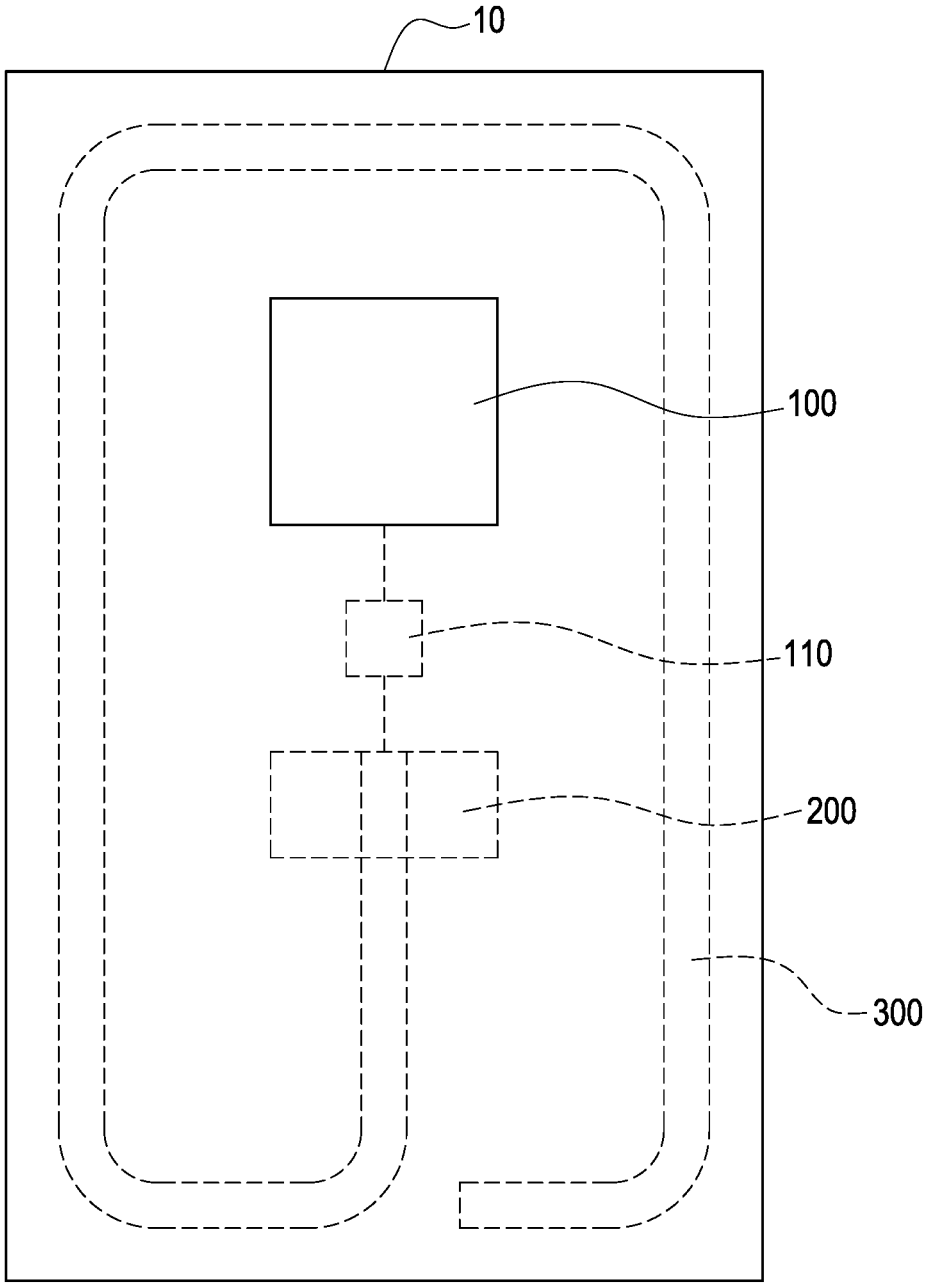

Referring to FIG. 5, the third embodiment of the present invention provides a fire scene evacuation guiding device, comprising a door panel 10, two indicators 100, a thermoelectric converter 200 disposed corresponding to the indicator 100, and a control module 110 corresponding to the indicator 100.

The indicator 100 is the same as that in the first embodiment. In the present embodiment, the two indicators 100 are disposed at two opposite sides of the door panel 10, respectively.

The thermoelectric converter 200 is the same as that in the first embodiment. In the present embodiment, the thermoelectric converter 200 is disposed in the door panel 10. The first detecting end 210 and the second detecting end 220 are disposed at two opposite sides of the door panel 10, respectively. Each of the first detecting end 210 and the second detecting end 220 can be selectively thermally coupled to a heat conductive pipe 300. The heat conductive pipe 300 can extend on a surface of the door panel 10, so that a detection range can extend to the whole door panel 10. It is preferable that, a heat conductive insulating structure 400 is connected between each of the heat conductive pipes 300 and each of the first detecting end 210 and the second detecting end 220 thermally coupled to the respective heat conductive pipes 300. The heat conductive insulating structure 400 preferably consists of a ceramic material.

The control module 110 is disposed at the door panel 10 and is electrically connected to each indicator 100 and the thermoelectric converter 200, so that the thermoelectric converter 200 is electrically connected to each indicator 100. The thermoelectric converter 200 generates a voltage from a temperature difference between the first detecting end 210 and the second detecting end 220. According to a value and a direction of the voltage generated by the thermoelectric converter 200, the control module 110 can activate the indicator 100 at one side of the door panel away from the fire scene, so as to identify the other side of the door panel 10 as the fire scene.

Figure 7:
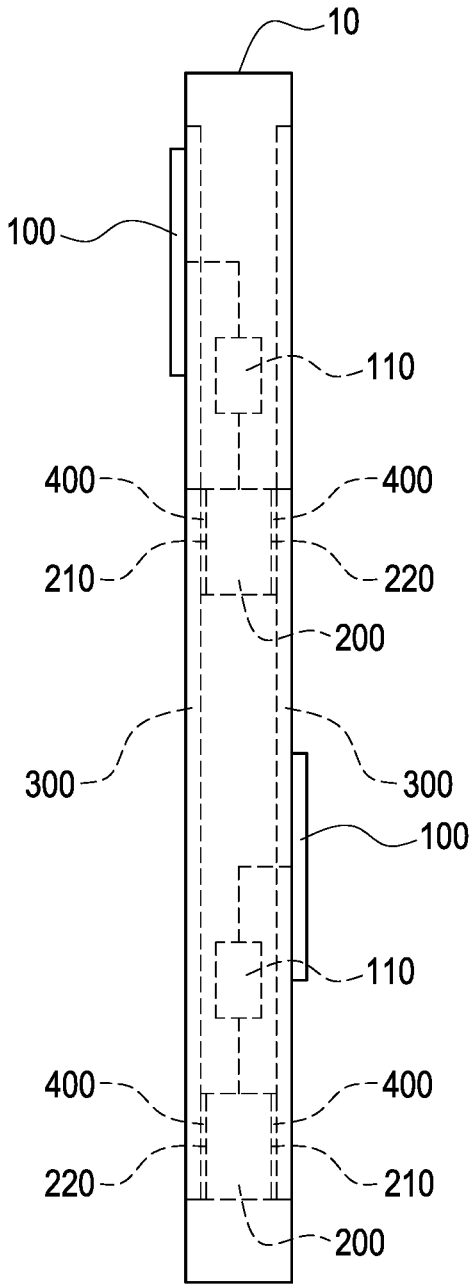
FIG. 7 is a schematic view illustrating the fire scene evacuation guiding device according to the fourth embodiment of the present invention.

Referring to FIG. 7, the fourth embodiment of the present invention provides a fire scene evacuation guiding device, comprising a door panel 10, an indicator 100, a thermoelectric converter 200, and a control module 110. The indicator 100, the thermoelectric converter 200, and the control module 110 are the same as those of the third embodiment. The present embodiment is different from the third embodiment in that, two sets of the same components are disposed at the door panel 10, and each set of components includes one indicator 100, one thermoelectric converter 200 and one control module 110.

The present embodiment is different from the third embodiment in that, when the temperature of the first detecting end 210 is lower than the temperature of the second detecting end 220, and a predetermined temperature difference between the first detecting end 210 and the second detecting end 220 is achieved, the thermoelectric converter 200 generates a sufficient voltage to activate the indicator 100 electrically connected thereto, so the other side of the door panel 10 can be identified as the fire scene. Therefore, two sets of the same components are disposed at two sides of the door panel 10 for giving indications separately.

In summary, the fire scene evacuation guiding device is activated by the thermoelectric converter 200, so that the evacuation instructions can be provided according to the real time situation at the fire scene. The thermoelectric converter 200 generates electric power from the heat at the fire scene, so extra power is not required.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A fire scene evacuation guiding device, comprising:

an indicator (100); and a thermoelectric converter (200), the thermoelectric converter (200) being electrically connected to the indicator (100), the thermoelectric converter (200) including a first detecting end (210) and a second detecting end (220), the first detecting end (210) and the second detecting end (220) being arranged away from each other, wherein each of the first detecting end (210) and the second detecting end (220) is thermally coupled to a heat conductive pipe (300).

2. The fire scene evacuation guiding device of claim 1, wherein a heat conductive insulating structures (400) is connected between each of the two heat conductive pipes (300) and each of the first detecting end (210) and the second detecting end (220) thermally coupled to the respective heat conductive pipes (300).

3. The fire scene evacuation guiding device of claim 2, wherein the heat conductive insulating structure (400) consists of a ceramic material.

4. The fire scene evacuation guiding device of claim 1, further comprising a control module (110), the control module (110) being electrically connected to the indicator (100) and the thermoelectric converter (200).

5. The fire scene evacuation guiding device of claim 4, further comprising another indicator (100) electrically connected to the control module (110).

6. A fire scene evacuation guiding device, comprising:

a door panel (10);

an indicator (100) disposed on one side of the door panel (10); and a thermoelectric converter (200), the thermoelectric converter (200) being electrically connected to the indicator (100), the thermoelectric converter (200) including a first detecting end (210) and a second detecting end (220), the first detecting end (210) and the second detecting end (220) being respectively disposed on two sides of the door panel (10), wherein each of the first detecting end (210) and the second detecting end (220) is thermally connected to a heat conductive pipe (300).

7. The fire scene evacuation guiding device of claim 6, further comprising a control module (110), the control module (110) being electrically connected to the indicator (100) and the thermoelectric converter (200).

8. The fire scene evacuation guiding device of claim 7, further comprising another indicator (100) electrically connected to the control module (110) and disposed on the other side of the door panel (10).

9. The fire scene evacuation guiding device of claim 6, wherein a heat conductive insulating structure (400) is connected between each of the two heat conductive pipes (300) and each of the first detecting end (210) and the second detecting end (220) thermally coupled to the respective heat conductive pipes (300).

10. The fire scene evacuation guiding device of claim 9, wherein the heat conductive insulating structure (400) consists of a ceramic material.

* * * * *